United States Patent [19]

Ciriaci

[11] Patent Number: 4,754,796

[45] Date of Patent: Jul. 5, 1988

[54] VERTICAL BLIND ASSEMBLY

[75] Inventor: Piergiorgio Ciriaci, Hollywood, Fla.

[73] Assignee: Micro Molds Corporation, Hialeah, Fla.

[21] Appl. No.: 5,888

[22] Filed: Jan. 22, 1987

[51] Int. Cl.[4] ..... E06B 9/30

[52] U.S. Cl. ..... 160/173

[58] Field of Search ..... 160/173, 166 A, 178 B, 160/178 R

[56] References Cited

U.S. PATENT DOCUMENTS 4,293,021 10/1981 Arena ..... 160/178 R

FOREIGN PATENT DOCUMENTS 2122675 1/1984 United Kingdom ..... 160/166 A

*Primary Examiner*—Ramon S. Britts
*Assistant Examiner*—Blair M. Johnson
*Attorney, Agent, or Firm*—John Cyril Malloy

[57] ABSTRACT

An end cap assembly specifically structured for positioning at either end of an elongated head casing of the type used to house and support a plurality of vertical blinds disposed in spaced apart depending relation and defining a vertical blind assembly wherein the vertical blinds may be rotated along their own longitudinal axis between an opened and closed position through manipulation of a pull chain or like structure and similarly may be collectively positioned in spread apart covering relation along a door opening, window, etc. through manipulation of a pull cord assembly or like structure. The end cap structure of the present invention is universally configured to be positioned at either end of the carrier frame by reversing its orientation but without necessitating structural modification thereof and further wherein the pull cord assembly is connected between oppositely disposed end caps on the carrier frame for manipulation collectively of the vertical blinds in the aforementioned manner.

14 Claims, 1 Drawing Sheet

VERTICAL BLIND ASSEMBLY

BACKGROUND OF THE INVENTION

1. Field of the Invention

This invention relates to end cap structures designed to be combined with a vertical blind assembly and more specifically capable of being mounted selectively on either end of an elongated carrier frame itself structured and designed to movably support a plurality of vertical blinds which are selectively positioned in overhanging relation to an opening such as a doorway, window, etc., and specifically, wherein the end caps are structured to be sufficiently versatile for mounting on the opposite ends of the carrier frame and in their intended connection with a pull cord assembly and a positioning rod used for the manipulation of the vertical blinds.

2. Description of the Prior Art

Vertical blind assemblies or structures of the type incorporating a plurality of vertically oriented and depending blinds capable of traversing the length of a track mounted in a suspended head casing are well known in the prior art and commercially available to the public in various forms and designs. Typically, such assembly provides for the traversing movement of the plurality of depending blinds in the aforementioned fashion and also allows the angular rotation or tilting of the blinds collectively into a common angular orientation about the respective longitudinal axis of the blinds. This angular orientation controls or regulates the amount of light or viewing through the individual blinds.

Vertical blind assemblies of the type mentioned above generally include a holder for each of the blinds removably secured to an upper end thereof. Each holder is pivotally or rotatably mounted on a carrier structure. The individual carrier structures are extendable along the length of the head casing or alternately retracted into a closely adjacent position. Such positioning depends on whether it is preferred to extend the vertical blinds along the entire length of the head casing or collect the blinds at one end thereof so as to allow complete passage or access through the openlng which the vertical blind assembly is intended to overhang and possibly cover. A positioning assembly is associated in driving interconnection wilh each of the carrier structures supporting the individual holders and attached blinds wherein such positioning means is structured to provide the aforementioned travel and/or angular or pivotal movement of the blinds.

Numerous U.S. patents are in existence which are specifically directed to the prior art of vertical blind assemblies. While the structures disclosed in such patents are considered to be operable for their intended and designed purpose, frequently numerous prior art structures are considered to be rather complex requiring specifically structured components, and therefore add to the initial expense of the vertical blind assembly or the cost of maintenance and/or repair of such structures. Such U.S. patents include but are not limited to the U.S. Pat. Nos. 4,293,021 to Arena; Hyman, 3,844,330; Benthin, 4,361,179; Debs, 4,386,644; Kehren, et al, 3,134,428; and Frentzel, et al, 4,306,608; 4,332,288, and 4,335,775.

In the prior art structures of the type set forth above, it is common to use the aforementioned elongated head casing movably supporting the plurality of vertical blinds in overhanging relation to the opening such as a doorway or window. Associated with the aforementioned head casing are end cap structures which, in many instances, are specifically structured to include rollers or pullies designed to support and allow movement of a pull cord relative to the head casing. Such pull cord assembly may be manipulated by the user of the vertical blind assembly to position the plurality of vertical blinds collectively along the length of the head casing in overlying relation to the opening or alternately in immediate adjacent relation to one another at one or both ends of the head casing.

However, one problem typically associated with the head casing generally and the end cap structures specifically is the normal requirement for designing and structuring two end caps specifically designed to be mounted on only one end (the right end or the left end) of the head casing in order to fit the components such as an elongated drive shaft used to individually rotate the plurality of vertical blinds as well as the aforementioned pull cord assembly. Because such end caps are both engaging opposite ends of the elongated drive shaft, to be described in greater detail hereinafter, and are intended to support and allow manipultation of the pull cord assembly, their structure has to be specifically oriented to the specific end of the carrier frame on which they are intended to be mounted. This in turn causes specifically different fabrication of differently structured, configured and designed end caps in turn causing additional cost in mold, fabrication, etc.

Accordingly, there is a need in the vertical blind industry for an end cap structure which is universally structured such that it can be adapted to fit either end of the carrier frame without significant structural modification and specifically without the requirement of forming two specifically different end cap structures.

SUMMARY OF THE INVENTION

This invention is directed towards a vertical blind assembly of the type incorporating a plurality of vertically oriented blinds supported in depending relation from a head casing. The head casing is secured to extend along a given length above an area such as a passageway, window, doorway, etc. Generally, dependent upon the parlicular structural application, the plurality of blinds are interconnected to a holder and a carrier means, the latter movably supported within the head casing on a track structured such that the plurality of blinds are supported to traverse the length of the head casing between a closed position, relative to the subject passage or doorway, and an open position relative thereto. The closed position is defined by the plurality of blinds disposed in spaced apart relation to one another and extending along the length, or a portion, of the head casing. The open position is defined by the plurality of blinds disposed in a collected contracted position, preferably at one or both ends of the casing such that the covered passage or doorway is clear of such blinds.

Each of the blinds is suspended in a manner which selectively allows for the pivotal or rotational orientation of each blind about its own longitudinal axis. Therefore, the vertical blinds may be angularly oriented collectively so as to allow light to pass therethrough or viewing therethrough or alternately, to obstruct ight or viewing therethrough.

In order to accomplish the traversing movement of the blinds between the aforementioned opened and closed position, a pull cord assembly extends in depending relation from the head casing generally downwardly from one end thereof so as to be manipulatable by one operating the vertical blind assembly. Further, this cord assembly extends along the entire length of the head casing generally on the interior thereof and generally through or in cooperation with each of the carrier frames associated with the support of each of the individual blinds. The pull cord is connected between two pulley assemblies wherein each pulley assembly is located in a mounted fashion on one of two end caps. These end caps are positioned at the opposite ends of the head casing and generally define the extremities thereof. Further, the end caps serve to support a drive shaft also extending along the length of the head casing and being splined so as to cooperate with certain gear elements of the carrier frames which, when rotatated, by a pull chain causes the rotation of the drive shaft and the individual rotation of the vertical blinds along their own longitudinal axis.

An important feature of the present invention is the universal structural configuration of the end caps such that one end cap having the structural configuration to be described in greater detail hereinafter can be used at either end of the head casing and also be adapted to have an appropriately mounted pulled assembly secured thereto. Also, the universal structural configuration of the end cap structure is such as to allow engagement of the drive shaft into the respectively positioned end cap as well as allow an appropriately configured and structured pulley assembly to be mounted thereon in a specific location depending upon which end of the head casing the subject end cap structure is atlached thereto.

Also, in the operation of the subject vertical blind assembly of the type described herein is the provision of one end cap structure having a pulley means including a pair of side-by-side roller or pulley elements disposed in coaxial relation to one another and adapted to receive both strands of the pull cord. Such double pulley assembly is located at what may be referred to as the "operative" end of the head casing from which the manipulable portion of the pull cord depends downwardly for access to the operator. The pull cord assembly extends outwardly along the length of the head casing from this end cap incorporating the double pulley assembly to the opposite end wherein at least one strand of the pull cord drapes about a single pulley assembly comprising a single roller or pulley element rotatably mounted on the opposite end cap.

Accordingly, it should be readily apparent that regardless of whether end caps are utilized using a single pulley assembly or a double pulley assembly, the end cap structure of the present invention is designed to be structurally configured in a universal manner which will allow the adaptation and positioning of any end cap to either opposite end of the head casing wherein such reversal of the end cap structure merely requires a reverse orientation of the subject end cap and a positioning of the subject pulley means associated therewith in what may be referred to as a lowermost position, as will be explained in greater detail hereinafter.

This invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
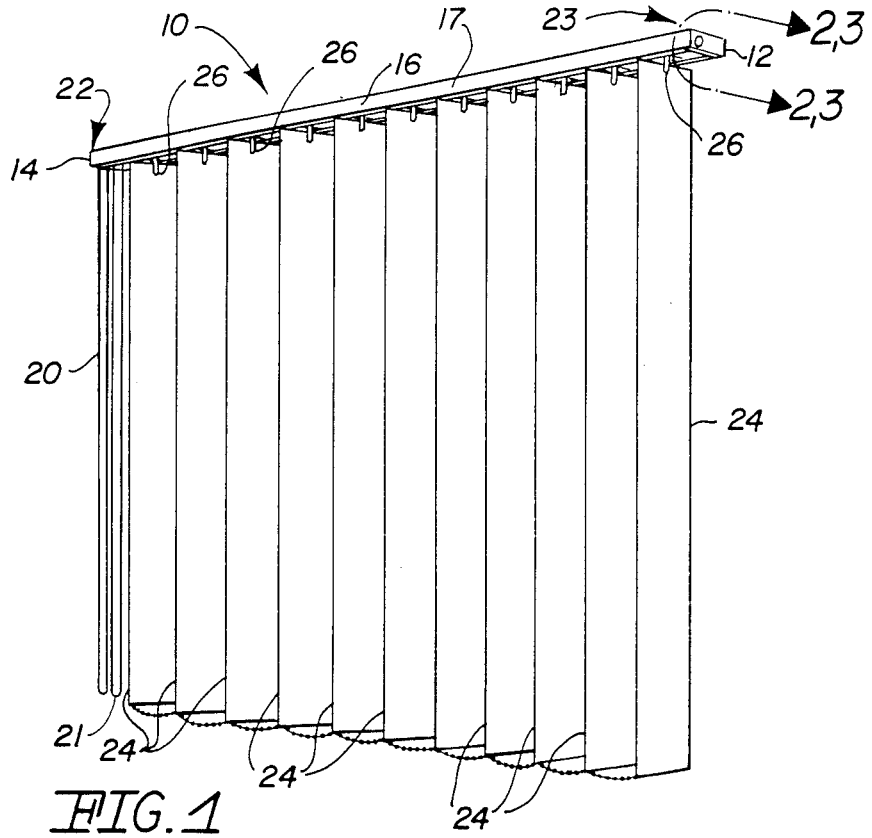
FIG. 1 is an isometric view of a vertical blind assembly of present invention with which the subject end cap structure is used and specifically the head casing associated therewith.
Figure 2:
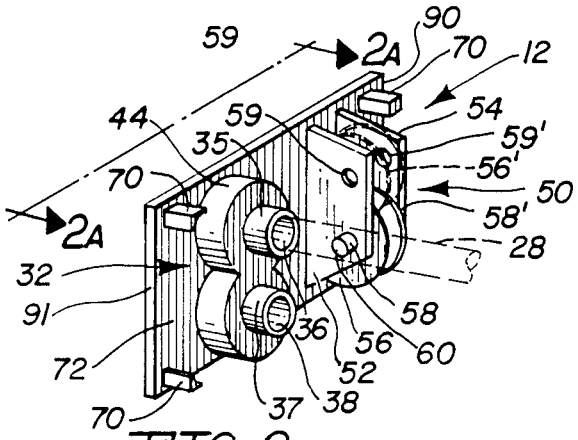
FIG. 2 is a perspective view showing details of one embodiment of the end cap structure of the present invention with certain alternate positions of cooperating components represented therein in phantom lines.
Figure 3:
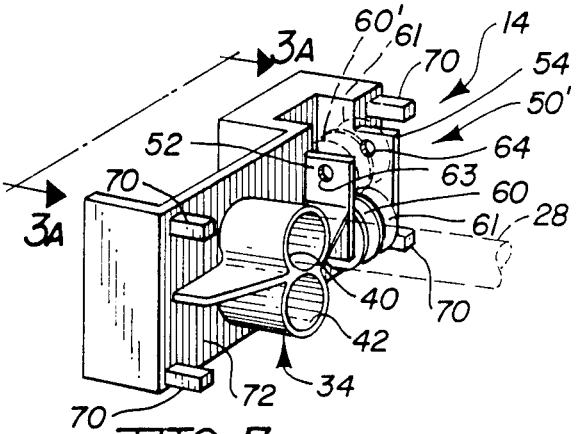
FIG. 3 is a perspective view of another embodiment of the end cap structure of the present invention wherein certain positionings of additional cooperative components with the end cap structure is represented in phantom lines.
Figure 2A:
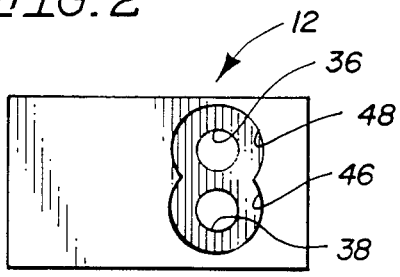
FIG. 2A is a rear plan view along line 2A—2A of FIG. 2.
Figure 3A:
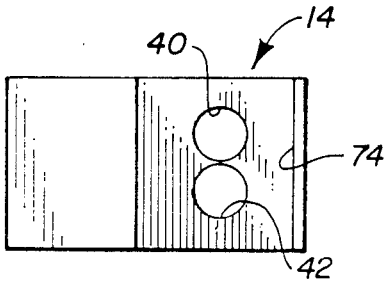
FIG. 3A is a rear view along lines 3A—3A of FIG. 3.

As shown in FIG. 1 through 3, the present invention is generally directed towards a vertical blind assembly generally indicated as 10 and more specifically, an end cap structure generally indicated as 12 and 14, in varying embodiments, designed to be mounted on a head casing 16 at opposite ends thereof so as to cooperate with a pull cord assembly 20 depending down from one end 22 of the head casing 16 so as to be readily accessible to one operating the vertical blind assemby 10. Typically, the vertical blind assembly 10 includes a plurality of individual vertical blinds 24 each depending from a carrier frame or structure (not shown for purposes of clarity) and secured thereto by individual holders 26 which may be removably secured to the carrier structure. Further, each of the holders and accordingly the individual vertical blinds 24 are rotatable or pivotal along their own central longitudinal axis by manipulation of a pull chain 21 which in turn drive an appropriate gear or like mechansim to rotate a positioning rod or drive shaft 28. The positioning rod 28 extends along the length of and on the interior of the head casing 16 and is interconnected to each of the carrier structures in such a manner, to proper gearing, to cause the aforementioned individual rotation of the vertical blinds 24 thereby regulating the amount of light into and out of or viewing through the opening over which the vertical blinds are positioned when in the collective orientation as shown in FIG. 1. An important feature of the present invention is the provision in the end cap structure 12 and/or 14 of the present invention of a rod receiving means generally indicated as 32 and 34 respectively. Each of the rod receiving means includes at least two openings 36 and 38 as in end cap 12 and 40 ad 42 as in end cap 14. With regard to FIGS. 2 and 2A, the end cap structure 12 includes outwardly extending sleeves 35 and 37 surrounding and defining the boundaries of the apertures 36 and 38 which are provided to receive the appropriately positioned ends of the positioning rod or drive shaft 28 therein. Further, the sleeves 35 and 37 are part of an outwardly projecting casing 44 which, as shown in FIG. 2A, includes recessed areas 46 and 48.

The recesses 46 and 48 may be positioned to allow passage of the appropriately positioned end of the positioning rod 28 therethrough into engagement with a gear, bearing assembly, additional pulley mechanism or the like means which facilitates its maintenance in the position shown in phantom lines in FIG. 2 or alternately, facilitates its rotation.

Further with regard to the embodiment of FIG. 2, a pulley assembly generally indicated as 50 is mounted thereon and comprises a pair of spaced apart flanges 52 and 54 in which a single pulley element 56 may be mounted. An important feature of the present invention is the provision of a first mounting means including coaxially spaced apart apertures 58, 58' through which a pin 60 is positioned and on which the pulley mechanism 56 rotates. The provision of a second pulley mounting means is also in the form of coaxially spaced apart apertures 59 and 59' formed in each of the flanges 52 and 54 but above and in spaced relation to the apertures 58 and 58' comprising the first pulley mounting means. Accordingly, the structural configuration as pictured in FIG. 2 of the end cap 12 allows for the mounting of the end cap 12 on one end (see FIG. 1) in cooperative position relative to the positioning rod 28 and the single used pulley element 56 appropriately positioned in the first receiving aperture 36 of the rod positioning means 32 and respectively wherein the pulley mechanism 56 is located in the lowermost pulley supporting means including apertures 58 and 58'. However, this same end cap 12 can be used at the opposite end as at 22 of the head casing 16 merely by reversing the orientation from that shown in FIG. 2. In such reversed orientation, the pulley mechanism 56 would be located in the position represented in phantom lines as 56' and the positioning rod 28 would be located within aperture 38 surrounded by sleeve 37. However, the reverse orientation of end cap 12 would cause the supporting means 32 for the positioning rod to be located essentially where the location of the pulley means 50 is located and reversally the pulley means 50 would be located in the orienlation of the support 32 for the positioning rod.

For purposes of clarity, the reverse orientation of end cap 12 will be described with regard to one longitudinal end 22 of the head casing 16 relative to an opposite longitudinal end 23 of the head casing 16 and also one side of head casing 16 indicated as 17 with regard to an opposite longitudinal side not clearly pictured. Further with regard to FIG. 2, a first end of end cap 12 will be designated 90 and a second 91. Accordingly, by way of explanation, when end cap 12 is positioned in mounted relation at opposite end 23 of the head casing 16, the first end 90 and the pulley assembly 50 may be positioned adjacent the front side 17 of the head casing and the positioning rod receiving means 32 which is positioned substantially adjacent the second end 91 of end cap 12 will be positioned substantially adjacent to the rear or other longitudinal side of the head casing 16 opposite to the longitudinal side 17. In such a reverse orientation, the pulley element as at 56' is inserted and the pulley element 56 in solid lines is removed. The reverse orientation then finds the end cap 12 mounted at the one end 22 of the head casing such that the first end 90 and the pulley assembly 50 are disposed substantially adjacent to the longitudinal side 17 of head casing. Conversely, when the end cap 12 is mounted on end 22 of the head casing 16, the rod receiving means 32 and the second end 91 of the end cap is mounted adjacent to the opposite longitudinal side of the head casing 16 relative to the frontal longitudinal side 17.

As shown in FIG. 3, another embodiment of the present invention comprises the end cap 14 having the pulley mechanism generally indicated as 50' and including mounting means including two spaced apart apertures (not shown) for the mounting of the double pulley assembly 60 and 61 in side-by-side coaxial relation to one another such that both rotate relative to one another. The spaced apart flanges 52 and 54 have a second set of pulley mounting structures including coaxially disposed apertures each formed in a different one of the flanges 52 and 56 as at 63 and 64.

Similarly, two apertures are formed as at 42 and 44 for the receipt of the positioning rod 28. Therefore, it should be readily apparent that the end cap 14 can also be located or positioned or mounted on the head casing 16 at either end thereof as at 22 and 23 merely by reversing the orientation into an upsidedown position which would effectively put the positioning rod support generally indicated as 34 into the position looated by the pulley means generally indicated as 50' and conversely put the pulley means 50' in the position represented in FIG. 3 by the support mans 34. The only difference would be that the positioning rod 28 would then be located in the uppermost aperture 42 and the double pulley mechanism 60' and 61 represented in phantom lines would be in the lowermost orientation on the flanges 52 and 54.

Regardless of the embodiments, the means to connect the individual end caps 12 and 14 to the appropriately positioned ends of the casing 16 comprises outwardly projecting fingers 70 located preferably in each of the corners of the innermost face 72. Such fingers provide a frictional engagement with the inner surfaces of the normally open ends of the head casing 16 in order to insure a snug fit thereto.

Further structural features of end cap 14 comprises the single inner recess 74 alowing for the mounting of bearing structures, pulleys, gears, or retainers on the end of the positioning rod 28 which passes through either of the apertures 40 or 42 depending upon the orientation of the end caps as set forth above.

Now that in invention has been described above, what is claimed is:

1. An end cap assembly designed for use with a vertical blind assembly and selectively mountable on either end of a head casing in cooperative connection with a pull cord and a positioning rod both used for positioning of a plurality of vertical blinds relative to the head casing, said end cap assembly comprising:

(a) a base including connecting means formed thereon and disposed and structured for securement to either opposite longitudinal ends of the head casing thereof, (b) receiving means formed on said base for receiving an end of the positioning rod cooperatively disposed relative to the end of the head casing to which said base is secured, (c) a pulley assembly including at least one pulley element disposed to receive the pull cord thereon and including a pulley mounting means secured to said base and structured to mount said one pulley element selectively in one of at least two predetermined positions, and (d) a mounting disposition of said one pulley element in either of said two predetermined positions dependent on an orientation of said base and the ends of the head casing on which it is mounted.

2. An assembly as in claim 1 wherein said base comprises an inner face and an outer exposed face, said pulley assembly mounted on said inner face of said base and extending at least partially into an interior of said head casing in movable supporting relation to the pull cord.

3. An assembly as in claim 2 wherein said receiving means is formed on said inner face of said base in spaced relation to said pulley assembly, said pulley assembly mounted substantially adjacent a first end of said base and said receiving means mounted substantially adjacent a second end of said base.

4. An assembly as in claim 3 wherein said first end of said base and said pulley assembly are disposed substantially adjacent one longitudinal side of said head casing and said first end of said base and said receiving means are disposed in substantially adjacent and opposite sides of said head casing when said base is mounted on a first end of said head casing.

5. An assembly as in claim 4 wherein said base is positioned in a reverse orientation when mounted on said second end of said head casing, said reverse orientation defined by said second end of said base and said receiving means disposed substantially adjacent said one side of said head casing and said first end of said base and said pulley assembly disposed substantially adjacent said opposite side of said head casing.

6. An assembly as in claim 1 wherein said receiving means comprises at least two receiving openings formed in said base and each dimensioned to receive an end of the positioning rod therein.

7. An assembly as in claim 6 wherein each of said two receiving openings are disposed to receive a different opposite end of the positioning rod therein, a disposition of one of said receiving openings engaging the positioning rod depending on an orientation of said base and the end of said head casing to which said base is attached.

8. An assembly as in claim 6 wherein said receiving means comprises a casing integrally formed on said base and projecting inwardly beyond an inner surface thereof into the interior of said head casing, a recess formed within said casing being dimensioned and configured to receive means for engaging an outer extremity of the positioning rod connected to said base.

9. An assembly as in claim 8 wherein each of said receiving openings is further defined by a surrounding sleeve disposed in surrounding relation with a correspondingly positioned end of said positioning rod.

10. An assembly as in claim 1 wherein said pulley assembly comprises two spaced apart flanges extending outwardly from an inner surface of said base and relatively disposed to rotatably receive said one pulley element therebetween.

11. An assembly as in claim 10 wherein said pulley mounting means is formed on said two flanges and includes an aperture means integrally formed in each flange, said aperture means of each flange disposed in aligned relation to one another and each dimensioned and configured for the rotatable mounting of said one pulley element selectively in either of said two predetermined positions.

12. An assembly as in claim 11 further comprising a support pin positioned between said flanges and having opposite ends thereof engaging said aperture means of each flange, said one pulley element rotatably mounted on said pin between said flanges and in one of said two predetermined positions dependent upon the orientation of said base and the end of the head casing on which it is mounted.

13. An assembly as in claim 11 wherein each aperture means comprises two spaced apart apertures integrally formed in the same flange, each of said two apertures of each flange disposed in coaxial relation with a correspondingly positioned aperture of the other of said two flanges.

14. An assembly as in claim 1 wherein said one pulley element comprises a double pulley structure comprising two pulleys oapable of rotating relalive to one another and being coaxially aligned to engage different strands of the pull cord.

* * * * *